US010220323B1

(12) United States Patent
Landon

(10) Patent No.: US 10,220,323 B1
(45) Date of Patent: Mar. 5, 2019

(54) COMBINATION STUFFED TOY, SLEEPING BAG, AND STORAGE ENCLOSURE

(71) Applicant: Billie Landon, Lancaster, NH (US)

(72) Inventor: Billie Landon, Lancaster, NH (US)

( * ) Notice: Subject to any disclaimer, the term of this patent is extended or adjusted under 35 U.S.C. 154(b) by 0 days.

(21) Appl. No.: 15/341,507

(22) Filed: Nov. 2, 2016

(51) Int. Cl.
*A63H 3/00* (2006.01)
*A47G 9/02* (2006.01)
*A63H 3/02* (2006.01)
*A47G 9/08* (2006.01)

(52) U.S. Cl.
CPC ..... *A63H 3/003* (2013.01); *A47G 9/08* (2013.01); *A63H 3/02* (2013.01)

(58) Field of Classification Search
CPC ..... A63H 3/003; A63H 3/005; A63H 3/02; A63H 33/004; A47G 9/0207; A47G 9/0223; A47G 9/083; A47G 9/1045
USPC ..... 446/72, 73, 369; 5/413 R, 482, 485
See application file for complete search history.

(56) References Cited

U.S. PATENT DOCUMENTS 2,078,809 A * 4/1937 Richman ..... A63H 3/12 446/268
4,543,669 A * 10/1985 Katz ..... A41D 11/00 2/84
4,590,633 A * 5/1986 Pickens ..... A47G 9/0207 446/369
4,734,948 A * 4/1988 Danova ..... A47G 9/0207 428/100
4,739,529 A * 4/1988 Mills ..... A63H 3/003 2/69.5
4,754,512 A * 7/1988 Chao-Yang ..... A47D 15/003 446/226
4,774,734 A * 10/1988 Mills ..... A45C 9/00 2/69.5
4,856,131 A * 8/1989 Mills ..... A63H 3/003 5/413 R
4,889,512 A * 12/1989 Burnett ..... A63H 3/005 446/72
5,046,980 A * 9/1991 Tai ..... A41B 13/10 2/49.4
5,084,930 A * 2/1992 Danova ..... A47G 9/0207 446/73
5,421,045 A * 6/1995 Bowen ..... A47G 9/0207 446/73
5,622,300 A * 4/1997 Robinson ..... A45C 3/10 190/2
6,141,805 A * 11/2000 Fisher-Cohen ..... A47D 15/003 5/413 R (Continued)

*Primary Examiner* — Alexander Niconovich

(57) ABSTRACT

A combination stuffed toy, sleeping bag, and storage enclosure including a foldable sleeping bag and a flexible stuffed covering. Each of a plurality of a pair of interconnectable strap buckles is attached to the flexible stuffed covering within each of a plurality of a pair of strap pockets disposed on the flexible stuffed covering. A handle is centrally attached to an upper side of the flexible stuffed covering. A first fastening element of each of a plurality of fasteners is disposed on a lower side of the flexible stuffed covering, and a second fastening element of each of the plurality of fasteners is disposed on each of the upper side of the flexible stuffed covering and the foldable sleeping bag. The first fastening element of each of the plurality of fasteners is detachably connected to the second fastening element of each of the plurality of fasteners.

1 Claim, 6 Drawing Sheets

(56) References Cited

U.S. PATENT DOCUMENTS

| | | | | |
|---|---|---|---|---|
| 6,343,968 | B1 * | 2/2002 | Louie | A45F 4/08 2/69.5 |
| 6,386,761 | B1 * | 5/2002 | Bohnsack | A45C 3/00 383/24 |
| 6,421,852 | B1 * | 7/2002 | Shao | A63H 3/005 446/73 |
| 6,427,267 | B1 * | 8/2002 | Turner | A47G 9/0223 446/369 |
| 6,434,769 | B1 * | 8/2002 | Koenig | A47D 15/00 446/369 |
| 7,013,507 | B2 * | 3/2006 | Cook | A41B 13/06 2/69.5 |
| 7,367,070 | B2 * | 5/2008 | Akkad | A47D 11/00 5/413 R |
| 7,987,536 | B1 * | 8/2011 | Habig | A47G 9/086 5/413 R |
| 8,256,045 | B2 * | 9/2012 | Cruz | A45C 9/00 383/4 |
| 8,672,724 | B2 * | 3/2014 | Beuerle | A47G 9/0253 446/369 |
| 8,864,544 | B2 * | 10/2014 | Anderman | A63H 3/003 2/75 |
| 8,869,325 | B2 * | 10/2014 | Ng | A47G 9/0223 5/485 |
| 9,226,565 | B1 * | 1/2016 | Martin | A45F 4/06 |
| 9,573,073 | B1 * | 2/2017 | Mazur | A63H 33/004 |
| 9,878,256 | B2 * | 1/2018 | Jones | A47G 9/08 |
| 2008/0182478 | A1 * | 7/2008 | Smoot | A63H 3/003 446/72 |

* cited by examiner

COMBINATION STUFFED TOY, SLEEPING BAG, AND STORAGE ENCLOSURE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of sleeping bags are known in the prior art. However, what has ii been needed is a combination stuffed toy, sleeping bag, and storage enclosure including a foldable sleeping bag and a flexible stuffed covering. What has been further needed is for each of a plurality of a pair of strap pockets to be disposed on the flexible stuffed covering and for each of a plurality of a pair of interconnectable strap buckles to be attached to the flexible stuffed covering within each of the plurality of a pair of strap pockets. Lastly, what has been needed is for a first fastening element of each of a plurality of fasteners to be disposed on a lower side of the flexible stuffed covering and for a second fastening element of each of the plurality of fasteners to be disposed on each of an upper side of the flexible stuffed covering and the foldable sleeping bag. The first fastening element of each of the plurality of fasteners is detachably connected to the second fastening element of each of the plurality of fasteners in order to selectively encase the flexible stuffed covering around the foldable sleeping bag for ease of transport. The combination stuffed toy, sleeping bag, and storage enclosure thus allows a child to easily transport both a sleeping bag and a stuffed toy while traveling, since each side of the flexible stuffed covering, optionally shaped like an animal, can be fastened together to form a toy.

FIELD OF THE INVENTION

The present invention relates to sleeping bags, and more particularly, to a combination stuffed toy, sleeping bag, and storage enclosure.

SUMMARY OF THE INVENTION

The general purpose of the present combination stuffed toy, sleeping bag, and storage enclosure, described subsequently in greater detail, is to provide a combination stuffed toy, sleeping bag, and storage enclosure which has many novel features that result in a combination stuffed toy, sleeping bag, and storage enclosure which is not anticipated, rendered obvious, suggested, or even implied by prior art, either alone or in combination thereof.

To accomplish this, the present combination stuffed toy, sleeping bag, and storage enclosure includes a foldable sleeping bag having an upper surface, a lower surface, a top end, and a bottom end. A flexible stuffed covering has an upper side, a lower side, a right side, a left side, a right top corner, a left top corner, a right bottom corner, and a left bottom corner. A handle is medially centrally attached to the upper side of the flexible stuffed covering. A plurality of a pair of strap pockets includes a right top strap pocket, a left top strap pocket, a right bottom strap pocket, and a left bottom strap pocket. Each of the right top strap pocket, the left top strap pocket, the right bottom strap pocket, and the left bottom strap pocket is disposed on the flexible stuffed covering proximal each of the right top corner, the left top corner, the right bottom corner, and the left bottom corner, respectively. Each of the right top strap pocket, the left top strap pocket, the right bottom strap pocket, and the left bottom strap pocket has an interior surface, a top edge, and an interconnectable hook and loop fastener having a first strip disposed on the interior surface proximal the top edge and a second strip disposed on an exterior surface of the flexible stuffed covering.

The combination stuffed toy, sleeping bag, and storage enclosure further includes a plurality of a pair of interconnectable strap buckles including a top pair of strap buckles and a bottom pair of strap buckles. Each of the top pair of strap buckles and the bottom pair of strap buckles has a male attachment member and a female attachment member. The male attachment member of each of the top pair of strap buckles and the bottom pair of strap buckles is attached to the flexible stuffed covering within each of the left top strap pocket and the left bottom strap pocket, respectively, and the female attachment member of each of the top pair of strap buckles and the bottom pair of strap buckles is attached to the flexible stuffed covering within each of the right top strap pocket and the right bottom strap pocket, respectively. The male attachment member of each of the top pair of strap buckles and the bottom pair of strap buckles is removably disposed within each of the left top strap pocket and the left bottom strap pocket, respectively, and the female attachment member of each of the top pair of strap buckles and the bottom pair of strap buckles is removably disposed within each of the right top strap pocket and the right bottom strap pocket, respectively.

Each of a plurality of fasteners includes a first fastening element and a second fastening element. The first fastening element of each of the plurality of fasteners is disposed on the lower side of the flexible stuffed covering proximal the left side, and the second fastening element of each of the plurality of fasteners is disposed on each of the upper side of the flexible stuffed covering proximal the right side and the lower surface of the foldable sleeping bag proximal the bottom end. The first fastening element of each of the plurality of fasteners is selectively detachably connected to the second fastening element of each of the plurality of fasteners disposed on each of the upper side of the flexible stuffed covering proximal the right side and the lower surface of the foldable sleeping bag proximal the bottom end.

Each of the top pair of strap buckles and the bottom pair of strap buckles selectively securely encases the flexible stuffed covering around the foldable sleeping bag when the sleeping bag is in a rolled position. The connection between the first fastening element of each of the plurality of fasteners and the second fastening element of each of the plurality of fasteners disposed on the lower surface of the foldable sleeping bag attaches the foldable sleeping bag to the flexible stuffed covering for ease of foldability of the foldable sleeping bag.

The flexible stuffed covering is optionally shaped like an animal, and each of the right top corner, the left top corner, the right bottom corner, and the left bottom corner of the flexible stuffed covering is optionally shaped like a paw of the animal. The connection between the first fastening element of each of the plurality of fasteners and the second fastening element of each of the plurality of fasteners disposed on the upper side of the flexible stuffed covering proximal the right side forms a stuffed animal that will provide comfort to a child while the child is using the foldable sleeping bag.

Thus has been broadly outlined the more important features of the present combination stuffed toy, sleeping bag, and storage enclosure so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
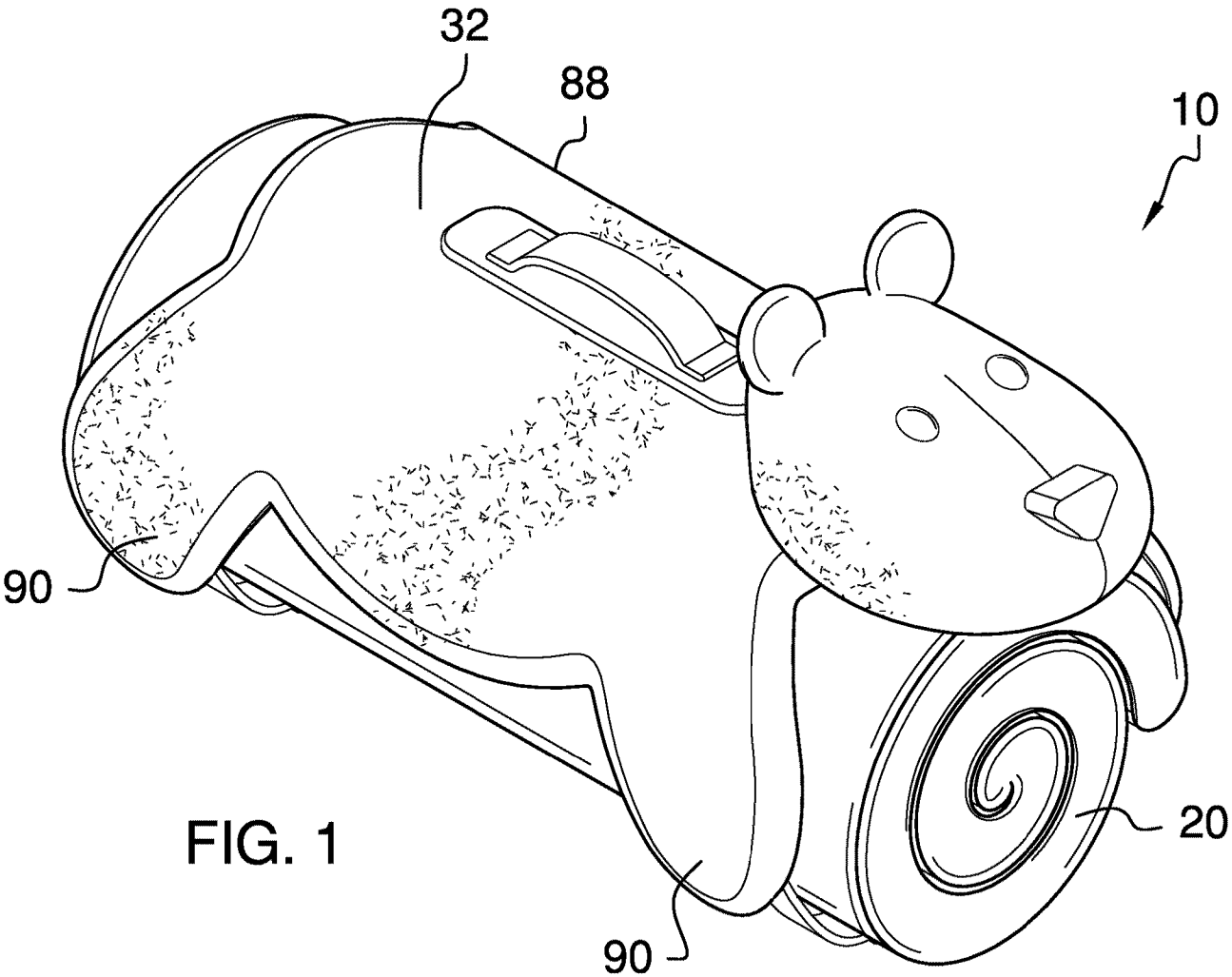
FIG. 1 is a front isometric view.
Figure 2:
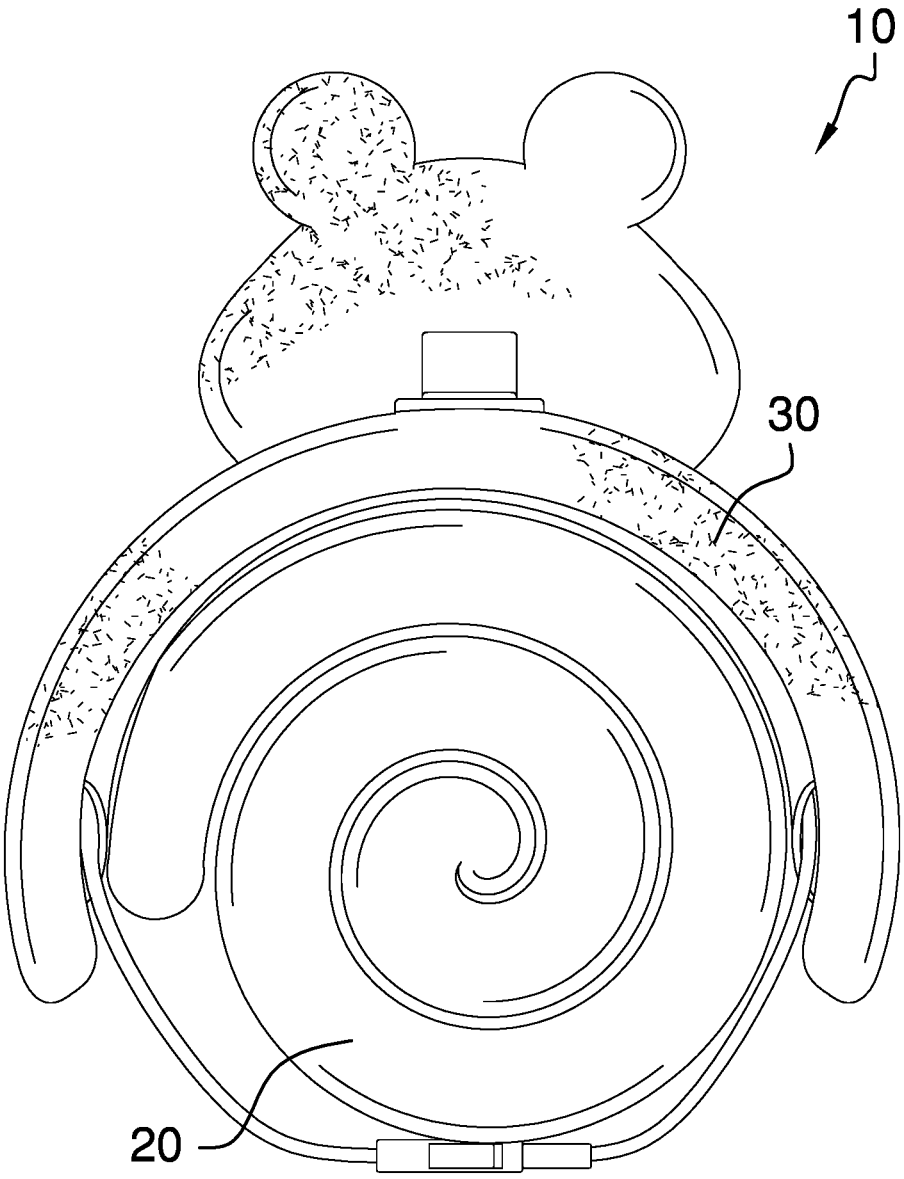
FIG. 2 is a rear elevation view.
Figure 3:
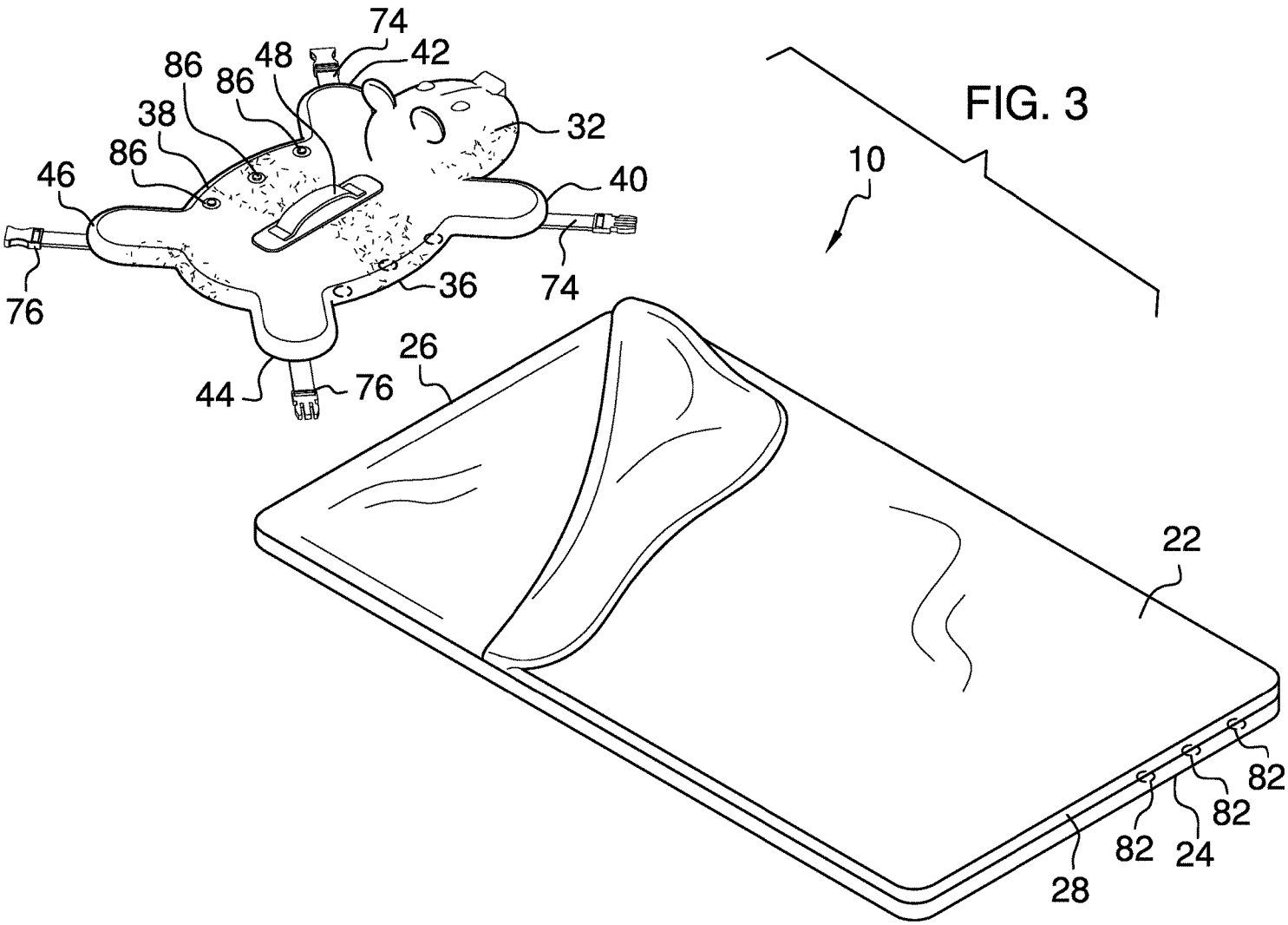
FIG. 3 is an exploded view.
Figure 4:
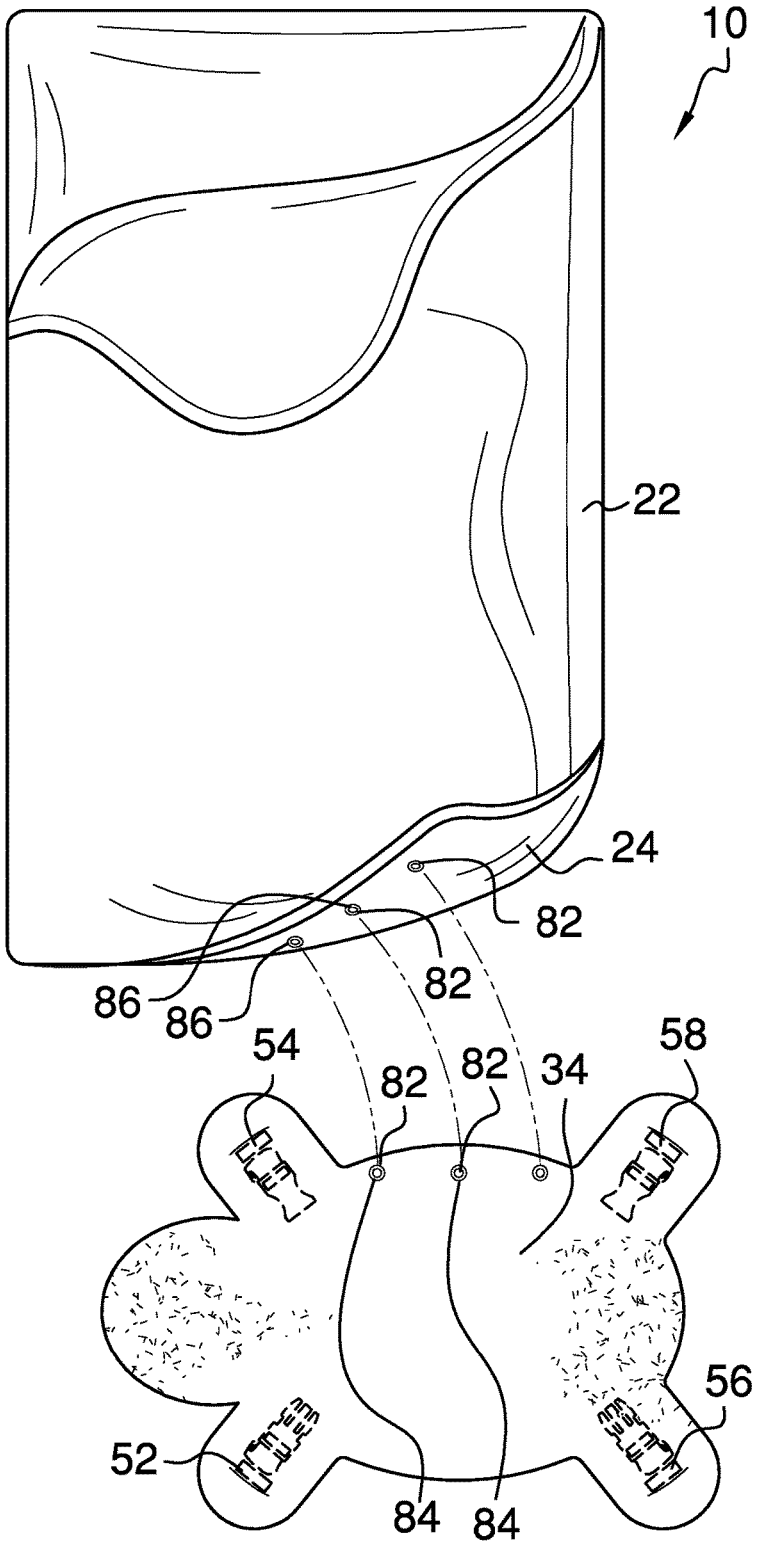
FIG. 4 is a bottom plan view showing a foldable sleeping bag detached from a flexible stuffed covering.
Figure 5:
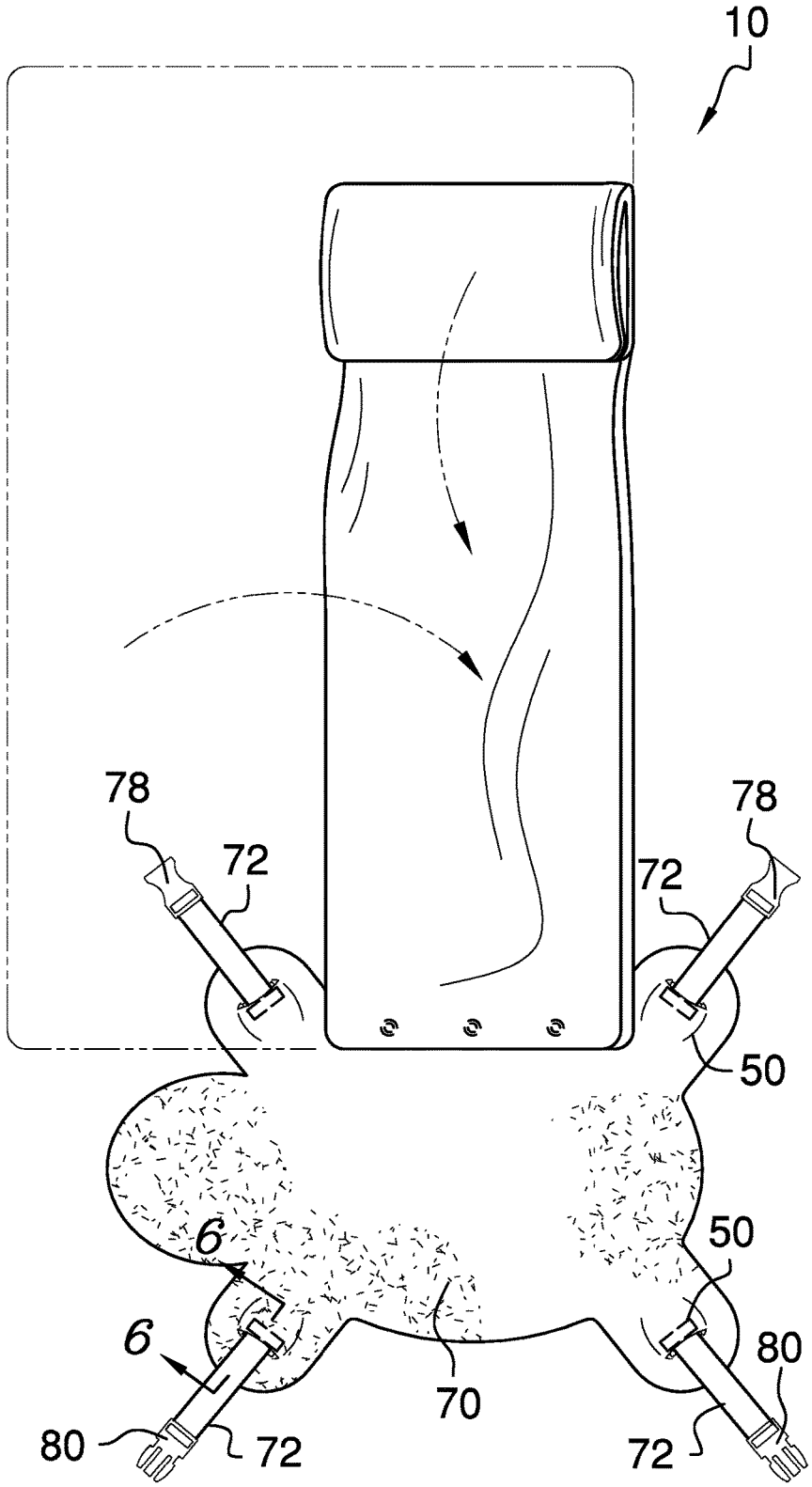
FIG. 5 is a bottom plan view showing the foldable sleeping bag attached to the flexible stuffed covering.
Figure 6:
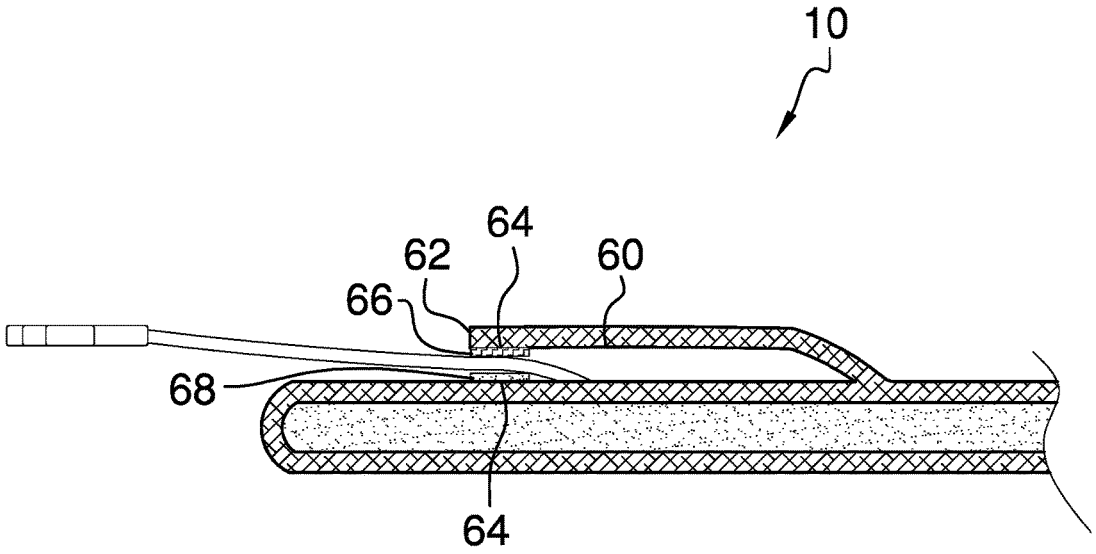
FIG. 6 is a cross-sectional view taken along line 6-6 of FIG. 5.

With reference now to the drawings, and in particular FIGS. 1 through 6 thereof, an example of the instant combination stuffed toy, sleeping bag, and storage enclosure employing the principles and concepts of the present combination stuffed toy, sleeping bag, and storage enclosure and generally designated by the reference number 10 will be described.

Referring to FIGS. 1 through 6 the present combination stuffed toy, sleeping bag, and storage enclosure 10 is illustrated. The combination stuffed toy, sleeping bag, and storage enclosure 10 includes a foldable sleeping bag 20 having an upper surface 22, a lower surface 24, a top end 26, and a bottom end 28. A flexible stuffed covering 30 has an upper side 32, a lower side 34, a right side 36, a left side 38, a right top corner 40, a left top corner 42, a right bottom corner 44, and a left bottom corner 46. A handle 48 is centrally attached to the upper side 32 of the flexible stuffed covering 30. A plurality of a pair of strap pockets 50 includes a right top strap pocket 52, a left top strap pocket 54, a right bottom strap pocket 56, and a left bottom strap pocket 58. Each of the right top strap pocket 52, the left top strap pocket 54, the right bottom strap pocket 56, and the left bottom strap pocket 58 is disposed on the flexible stuffed covering 30 proximal each of the right top corner 40, the left top corner 42, the right bottom corner 44, and the left bottom corner 46, respectively. Each of the right top strap pocket 52, the left top strap pocket 54, the right bottom strap pocket 56, and the left bottom strap pocket 58 has an interior surface 60, a top edge 62, and an interconnectable hook and loop fastener 64 having a first strip 66 disposed on the interior surface 60 proximal the top edge 62 and a second strip 68 disposed on an exterior surface 70 of the flexible stuffed covering 30.

The combination stuffed toy, sleeping bag, and storage enclosure 10 further includes a plurality of a pair of interconnectable strap buckles 72 including a top pair of strap buckles 74 and a bottom pair of strap buckles 76. Each of the top pair of strap buckles 74 and the bottom pair of strap buckles 76 has a male attachment member 78 and a female attachment member 80. The male attachment member 78 of each of the top pair of strap buckles 74 and the bottom pair of strap buckles 76 is attached to the flexible stuffed covering 30 within each of the left top strap pocket 54 and the left bottom strap pocket 58, respectively, and the female attachment member 80 of each of the top pair of strap buckles 74 and the bottom pair of strap buckles 76 is attached to the flexible stuffed covering 30 within each of the right top strap pocket 52 and the right bottom strap pocket 56, respectively. The male attachment member 78 of each of the top pair of strap buckles 74 and the bottom pair of strap buckles 76 is removably disposed within each of the left top strap pocket 54 and the left bottom strap pocket 58, respectively, and the female attachment member 80 of each of the top pair of strap buckles 74 and the bottom pair of strap buckles 76 is removably disposed within each of the right top strap pocket 52 and the right bottom strap pocket 56, respectively.

Each of a plurality of fasteners 82 includes a first fastening element 84 and a second fastening element 86. The first fastening element 84 of each of the plurality of fasteners 82 is disposed on the lower side 34 of the flexible stuffed covering 30 proximal the left side 38, and the second fastening element 86 of each of the plurality of fasteners 82 is disposed on each of the upper side 32 of the flexible stuffed covering 30 proximal the right side 38 and the lower surface 24 of the foldable sleeping bag 20 proximal the bottom end 28. The first fastening element 84 of each of the plurality of fasteners 82 is selectively detachably connected to the second fastening element 86 of each of the plurality of fasteners 82.

Each of the top pair of strap buckles 74 and the bottom pair of strap buckles 76 selectively securely encases the flexible stuffed covering 30 around the foldable sleeping bag 20 when the sleeping bag 20 is in a rolled position.

The flexible stuffed covering 30 is optionally shaped like an animal 88, and each of the right top corner 40, the left top corner 42, the right bottom corner 44, and the left bottom corner 46 of the flexible stuffed covering 30 is optionally shaped like a paw of the animal 90.

What is claimed is:

1. A combination stuffed toy, sleeping bag, and storage enclosure comprising:

a foldable sleeping bag having an upper surface, a lower surface, a top end, and a bottom end;

a flexible stuffed covering having an upper side, a lower side, a right side, a left side, a right top corner, a left top corner, a right bottom corner, and a left bottom corner;

a handle medially centrally attached to the upper side of the flexible stuffed covering;

a plurality of a pair of strap pockets comprising a right top strap pocket, a left top strap pocket, a right bottom strap pocket, and a left bottom strap pocket, each of the right top strap pocket, the left top strap pocket, the right bottom strap pocket, and the left bottom strap pocket disposed on the flexible stuffed covering proximal each of the right top corner, the left top corner, the right bottom corner, and the left bottom corner, respectively, wherein each of the right top strap pocket, the left top strap pocket, the right bottom strap pocket, and the left bottom strap pocket has an interior surface, a top edge, and an interconnectable hook and loop fastener having a first strip disposed on the interior surface proximal the top edge and a second strip disposed on an exterior surface of the flexible stuffed covering;

a plurality of a pair of interconnectable strap buckles comprising a top pair of strap buckles and a bottom pair of strap buckles, each of the top pair of strap buckles and the bottom pair of strap buckles having a male attachment member and a female attachment member, wherein the male attachment member of each of the top pair of strap buckles and the bottom pair of strap buckles is attached to the flexible stuffed covering within each of the left top strap pocket and the left bottom strap pocket, respectively, wherein the female attachment member of each of the top pair of strap buckles and the bottom pair of strap buckles is attached to the flexible stuffed covering within each of the right top strap pocket and the right bottom strap pocket, respectively;

wherein the male attachment member of each of the top pair of strap buckles and the bottom pair of strap buckles is removably disposed within each of the left top strap pocket and the left bottom strap pocket, respectively;

wherein the female attachment member of each of the top pair of strap buckles and the bottom pair of strap buckles is removably disposed within each of the right top strap pocket and the right bottom strap pocket, respectively; and a plurality of fasteners, each of the plurality of fasteners comprising a first fastening element and a second fastening element, wherein the first fastening element of each of the plurality of fasteners is disposed on the lower side of the flexible stuffed covering proximal the left side, and the second fastening element of each of the plurality of fasteners is disposed on each of the upper side of the flexible stuffed covering proximal the right side and the lower surface of the foldable sleeping bag proximal the bottom end;

wherein the first fastening element of each of the plurality of fasteners is selectively detachably connected to the second fastening element of each of the plurality of fasteners disposed on each of the upper side of the flexible stuffed covering proximal the right side and the lower surface of the foldable sleeping bag proximal the bottom end;

wherein each of the top pair of strap buckles and the bottom pair of strap buckles selectively securely encases the flexible stuffed covering around the foldable sleeping bag when the sleeping bag is in a rolled position;

wherein the flexible stuffed covering is shaped like an animal;

wherein each of the right top corner, the left top corner, the right bottom corner, and the left bottom corner of the flexible stuffed covering is shaped like a paw of the animal.

* * * * *